US005115931A

United States Patent [19]

Dubach

[11] Patent Number: 5,115,931

[45] Date of Patent: May 26, 1992

[54] ONE-PIECE PLASTIC SNAP-HINGE CLOSURE

[75] Inventor: Werner F. Dubach, Maur, Switzerland

[73] Assignee: Createchnic AG, Switzerland

[21] Appl. No.: 710,804

[22] Filed: Jun. 5, 1991

[30] Foreign Application Priority Data

Jun. 8, 1990 [CH] Switzerland ..... 01919/90

[51] Int. Cl.[5] ..... B65D 43/14

[52] U.S. Cl. ..... 215/235; 220/339

[58] Field of Search ..... 220/335, 339; 215/235, 215/237

[56] References Cited

U.S. PATENT DOCUMENTS

| | | | |
|---|---|---|---|
| 4,487,324 | 12/1984 | Ostrowsky | 215/253 |
| 4,638,916 | 1/1987 | Beck et al. | 215/235 |
| 4,696,408 | 9/1987 | Dubach | 215/237 |
| 4,778,071 | 10/1988 | Fillmore | 215/237 |
| 4,793,502 | 12/1988 | Beck | 215/235 |
| 4,795,044 | 1/1989 | Beck | 215/237 |
| 4,848,612 | 7/1989 | Beck | 215/235 |
| 4,854,473 | 8/1989 | Dubach | 220/335 |

*Primary Examiner*—Stephen Marcus
*Assistant Examiner*—Nova Stucker
*Attorney, Agent, or Firm*—Speckman & Pauley

[57] ABSTRACT

The closure consists of a lower part (1) and a cap (2), which are connected to each other by at least one film hinge (3). Spring elements (4) integrally formed from the jacket walls of the two closure parts are disposed on both sides of the film hinge (3). The thickness of the spring elements (4) varies between the shoulder points (5) of the spring elements. In the area of the shoulder points the thickness is approximately the same as the wall thickness of the jacket walls, and in the center, that is, in the area extending over the plane of separation, it is considerably less. The variation of the wall thickness permits a customer-specific adaptation of the snap action of the closure without having to make it in a completely new way every time.

4 Claims, 1 Drawing Sheet

ONE-PIECE PLASTIC SNAP-HINGE CLOSURE

BACKGROUND OF THE INVENTION

1. Field of the Invention

This invention relates to a one-piece plastic snap-hinge closure, having a lower part and a cap hingedly connected thereto, the cap and the lower part each having a jacket wall which, in the closed position of the closure, are located vertically flush above each other and are connected to each other by at least one film hinge located in their plane of separation, and having two spring elements, integrated into the jacket walls of the two parts, which generate the snap action.

2. Description of the Prior Art

The three most important points for the commercial success of a plastic closure are functionality, ease of manufacturing and aesthetic appearance. A fourth point is the price, which is always important. However, there are hardly any large differences, as far as one-piece closures are concerned, which can be manufactured without sliders in extrusion molds.

Functionality includes two essential criteria, namely closeness, the most essential function of any closure, and the snap action, a characteristic of a snap closure. Today, every snap closure achieves the required closeness, but the snap action varies considerably with different closures. This is obvious once it has been realized how complex the interaction of the different forces is and how this is affected by the geometry of the closure and its hinge.

The force for generating the snap action is always created by bending elasticity. Accordingly, it is possible to utilize a spring element or to design the geometry of the closure such that spring action results from elastic deformation of parts of the closure. The first variant, operating with spring elements, has been known for many years and employs a toggle joint as the spring element. The second variant employs so-called strap retainers which connect the cap and the lower part to each other, and at least one interposed film hinge, by which the two parts are pivotably connected to each other.

SUMMARY OF THE INVENTION

It is an object of this invention to provide a closure, even with use of strap retainers, having almost any characteristic in regard to the snap action.

This object is attained in accordance with this invention by a one-piece snap hinge closure of plastic, having a lower part and a cap hingedly connected therewith, the lower part and the cap each having a jacket wall which, in the closed position of the closure, are located vertically flush above each other and are connected to each other by at least one film hinge located in their plane of separation, and having two spring elements, integrated into the jacket walls of the two parts, which generate the snap action.

The spring elements comprise two strip-shaped parts, the thickness of which slowly decreases in the longitudinal direction from their two shoulder points towards the center. The shoulder points of the spring elements extend parallel to the plane of separation.

In accordance with one embodiment of this invention, the spring elements act on the parts of the plastic closure in the manner of a spring bar in the shoulder area and in the manner of a strap retainer in the central area.

In accordance with another embodiment of this invention in which the snap-hinge closure has a cylindrical shape, it is preferred that the spring elements be thinner in the places further away from the film hinge than in the more closely located sides, from the shoulder area towards the center.

In this way, it is possible to compensate for the different pivoting paths defined by the individual phases of a retainer as a function of the distance from the pivot axis.

An exemplary embodiment of this invention is shown in the drawings and will be described in reference thereto.

DESCRIPTION OF THE PREFERRED EMBODIMENTS

Figure 1:
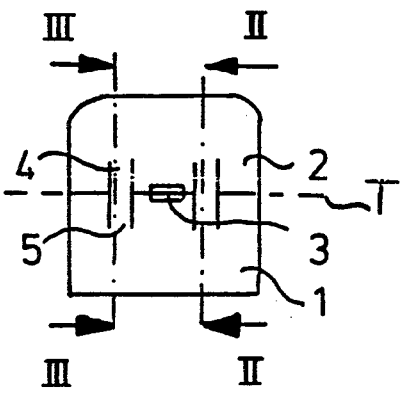
FIG. 1 is a rear view of the snap hinge of a plastic closure in accordance with one embodiment of this invention.

FIG. 1 shows a rear view of a one-piece plastic closure with a lower part 1 and a cap 2, hingedly connected to lower part 1. The plane of separation between the cap 2 and the lower part 1 is indicated by T. The cylindrical closure shown in the drawings has a film hinge 3 connecting the two closure parts, which slightly protrudes in respect to the jacket walls of the lower part 1 and cap 2, located vertically above each other. This protrusion of the film hinge 3 is essential for the closure to be extruded in the completely open position. Otherwise the jacket walls of the lower part 1 and the cap 2 would touch in the completely open position.

Lateral spring elements 4 are positioned to the left and right of the film hinge 3. The spring elements 4 are integrated into the jacket walls of lower part 1 and cap 2, that is, in the closed position of the closure, the spring elements are flush with the exterior of the jacket walls of both lower part 1 and cap 2 and make a direct transition into the jacket walls of both lower part 1 and cap 2 at the shoulder points 5.

Figure 2:
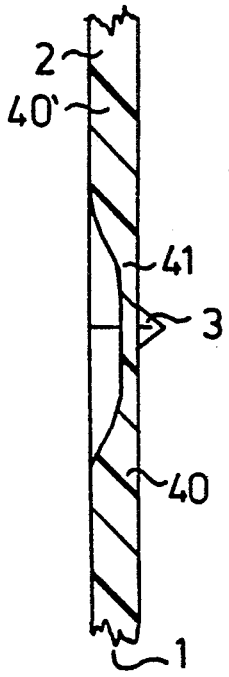
FIG. 2 is a longitudinal section of the spring element along the line II—II of FIG. 1.
Figure 3:
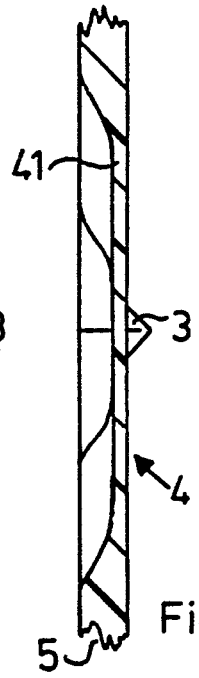
FIG. 3 is the same longitudinal section along the line III—III of FIG. 1.

The spring elements 4 have two separate areas with different functions shown most clearly in FIGS. 2 and 3. The two areas 40 and 40' of the spring elements merge directly, with the same wall thickness, from the corresponding jacket walls of the lower part 1 or the cap 2. Essentially, these areas act as spring bars, fixed on one side, which generate bending forces and thus are flexibly deformed when the closure is operated.

The extent of the bending forces depends on the material selected, which preferably is polyethylene, and on the geometrical parameters, namely width, length and thickness of the thick areas 40 and 40' of the spring elements 4.

An area 41 with a considerably lesser wall thickness remains between the above-described areas of thickness of the spring elements 4. This area 41 of decreased thickness has the same function as the known retaining straps, namely the transfer of tensile forces from one closure part to the other. The elastic longitudinal change occurring in this case is minimal. As a result, there is a compression of the portions of the wall adjacent to the film hinge 3, which results in increased snap action of the closure.

Figure 4:
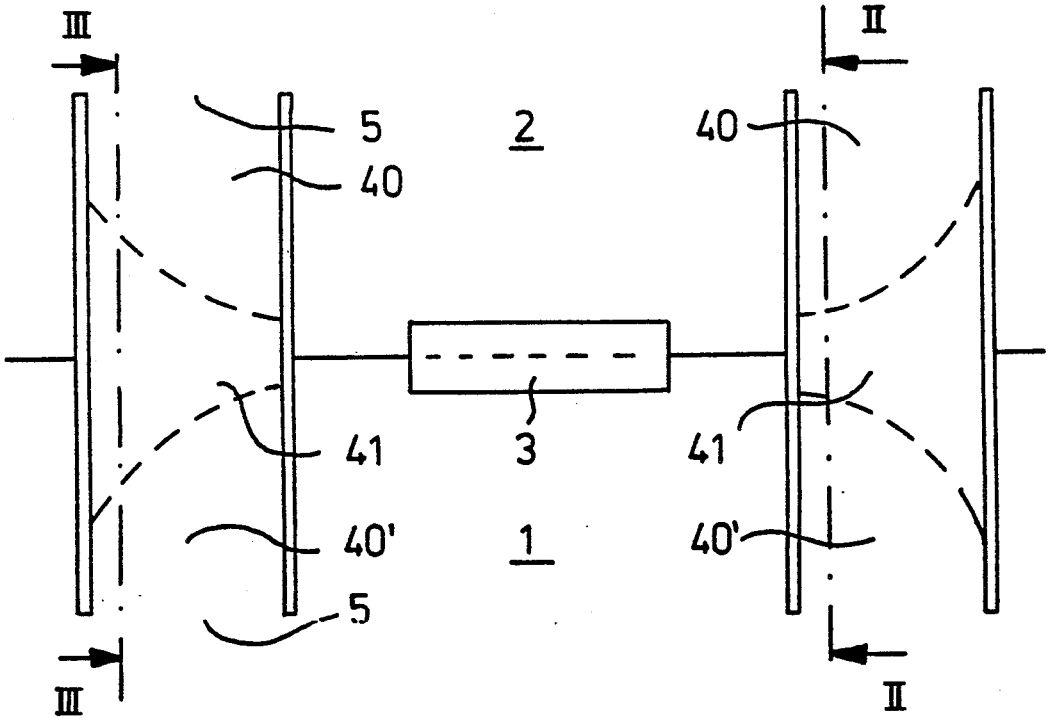
FIG. 4 is an enlarged view of the snap hinge in accordance with the embodiment shown in FIG. 1.

An additional element for varying the snap action comprises letting the transition from the thin-walled area 41 to the thick-walled area 40 or 40' extend in a curved or inclined manner. In this way the course of the transition from the thinner to the thicker wall strength, shown as the curvature of the closure jacket wall, is a simplification which only approximates the actual course. The curved course, shown by dash-dotted lines in FIG. 4, corresponds more closely to the actuality.

In accordance with another embodiment of this invention, the entire wall thickness of the spring elements 4 from the side lying higher than the film hinge 3 to the side facing away from it is varied. This, too, changes the force conditions.

In contrast to the conventional spring elements, which can hardly be varied and where the snap action almost completely depends on the geometry of the two closure parts, namely cover and lower part, in accordance with this invention, complete adaptation is provided by the actual hinge alone. As a result, the effect of appropriate corrections can be predicted.

Using appropriate, interchangeable inserts for the extrusion mold, closures having the same shape but with different characteristics can be manufactured. This permits the specific fulfillment of customer requests without having to provide a completely new extrusion mold every time.

I claim:

1. A one-piece plastic snap-hinge closure, having a lower part (1) and a cap (2) hingedly connected to said lower part (1), said lower part and said cap each having a jacket wall which, in a closed position of the closure, are located vertically flush above each other and are connected to each other by at least one film hinge located in a plane of separation of said lower part and said cap, and having two spring elements (4), integrated into the jacket walls of the lower part and the cap, which generate a snap action, the improvement comprising: the spring elements (4) comprising two strip-shaped members, each having a thickness which decreases in a longitudinal direction from shoulder points (5) of said strip-shaped members towards a center of said strip-shaped members, all said shoulder points (5) of the strip-shaped members extending parallel to a plane of separation (T).

2. A snap-hinge closure in accordance with claim 1, wherein said areas of decreased thickness (41) of the spring elements (4) on their sides further away from the film hinge (3) are in the longitudinal direction than on inner sides closer to the film hinge (3).

3. A snap-hinge closure in accordance with claim 1, wherein at least the middle third of the entire length of said spring elements is evenly thinned.

4. A snap-hinge closure in accordance with claim 2, wherein transitions from the thinned areas (41) to bordering thick-walled areas (40) of each spring element (4) are curved and from an area close to the film hinge (3).

* * * * *